US005682734A

United States Patent [19]

Laster

[11] Patent Number: 5,682,734

[45] Date of Patent: Nov. 4, 1997

[54] BAGGING MACHINE FOR INSERTING SEMI-COMPRESSIBLE ARTICLES INTO PREFORMED BAGS

[76] Inventor: James E. Laster, 3807 Derbyshire Dr., Greensboro, N.C. 27410

[21] Appl. No.: 559,600

[22] Filed: Nov. 20, 1995

[51] Int. Cl.[6] ..... B65B 43/18

[52] U.S. Cl. ..... 53/572; 53/255; 53/258; 53/284.7; 53/386.1; 53/493; 53/495; 53/529; 53/571

[58] Field of Search ..... 53/439, 493, 255, 53/495, 260, 258, 252, 284.7, 386.1, 529, 530, 570, 571, 572, 573, 436, 438, 523

[56] References Cited

U.S. PATENT DOCUMENTS

| | | | |
|---|---|---|---|
| 3,363,396 | 1/1968 | Lockrow et al. | 53/529 |
| 3,492,780 | 2/1970 | Bastasch | 53/386.1 X |
| 3,585,925 | 6/1971 | Fox | 53/529 X |
| 3,603,059 | 9/1971 | Carnes et al. | 53/572 X |
| 3,935,691 | 2/1976 | Broch | 53/572 X |
| 4,062,169 | 12/1977 | Lister et al. | 53/439 |
| 4,457,124 | 7/1984 | Hartmann | 53/512 |
| 5,457,935 | 10/1995 | Kope | 53/258 |
| 5,483,786 | 1/1996 | Giesbrecht et al. | 53/258 X |

*Primary Examiner*—Daniel Moon

[57] ABSTRACT

A bagging machine for inserting semi-compressible articles into preformed bags having a product loading arm vertically and horizontally mounted to the bag loading surface of a frame that can be programmed to move downwardly to engage a plurality of articles to be bagged and move them horizontally into an opened bag for subsequent removal to a remote location. A suction device engages a bag to positively open the bag to receive the compressed articles. A hold-down device also functions to direct the packaged articles downwardly and into a position for movement to a remote location. The bagging machine can be joined with a compactor and programmed to automatically receive compacted pluralities of articles for subsequent bagging. The compactor and bagging machine become fully automatic when a displacing device is associated with the compactor to move the compressed articles to the bag loading surface.

17 Claims, 3 Drawing Sheets

BAGGING MACHINE FOR INSERTING SEMI-COMPRESSIBLE ARTICLES INTO PREFORMED BAGS

BACKGROUND OF THE INVENTION

1. Field of the Invention

The present invention relates to bagging machines and more particularly to a bagging machine for inserting semi-compressible articles into preformed bags and thereafter directing the bagged articles to a remote location.

2. Description of the Prior Art

There are a number of automatic bagging machines in use that operate by receiving one or more articles sequentially into preformed and opened bags that are thereafter sealed and removed. Many of these devices operate by utilizing a pair of jaws that function to open one end of the preformed bag and enable the bag to receive one or more articles to be bagged. See, for example, U.S. Pat. Nos. 4,047,362; 4,106,260 and 4,241,562. As can be seen, these machines, while effective in operation, include many moving parts and require frequent maintenance. Moreover, the machines are relatively slow in operation and therefore, do not always meet production requirements.

Prior art machines also must be equipped with special handling machinery for receiving and positioning the bags and for delivering them to the filling station at the proper time. Such equipment increases the expense of the bag filling machine and serves further to reduce the operating speed.

Thus, it can be seen that there is a need for bagging machinery operable at higher rates of speed, and it is to this need that the present invention is directed.

OBJECTIVES AND SUMMARY OF THE INVENTION

It is, therefore, a primary objective of the present invention to provide a bagging machine of the type described that has all and more of the advantages of prior art devices and none of the disadvantages.

A further objective of the present invention is to provide a method for the automatic filling of bags which permits a high rate of production while making possible a relatively simplified construction of the required equipment.

Another objective of the present invention is to provide a machine of the type described which is simple and convenient in form and capable of achieving a tightly packaged bag.

Yet still another objective of the present invention is to provide a machine of the type described which can be used in conjunction with a compactor to fully automate the compaction and subsequent packaging of a plurality of semi-compressible articles.

The bagging machine comprising the present invention includes a frame having a bag loading surface, a product loading arm having arm supporting structure to enable vertical and horizontal movement of the product loading arm with respect to the bag loading surface and appropriate means for selectively moving the product loading arm vertically and horizontally to accomplish the packaging operation. A hold-down device is associated with the product loading arm, and a bag positioning and supporting mechanism is located adjacent the bag loading surface. Appropriate bag loading means is supported by the loading surface and operably associated with the bag positioning and supporting means. A suction device engages one of the bag top sides and positively open the bag to receive compressed articles. A bag receiving device is located adjacent the loading surface and is positioned to receive article loaded bags for movement to a remote location. The frame may also include appropriate structure utilizing a compactor for compressing articles to be bagged and a displacing element associated with the compactor to move the compressed articles to the bag loading surface.

Thus, there has been outlined, in summary form, the more important features of the invention in order that the detailed description that follows may be better understood and in order that the present contribution to the art may be better appreciated. There are obviously additional features of the invention that will be described hereinafter and which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention or the application which is measured by the claims nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific object obtained by its use, reference should be made to the accompanying drawings and descriptive matter in which like characters of reference designate like parts throughout the several views.

DETAILED DESCRIPTION OF THE PREFERRED EMBODIMENT

Figure 1:
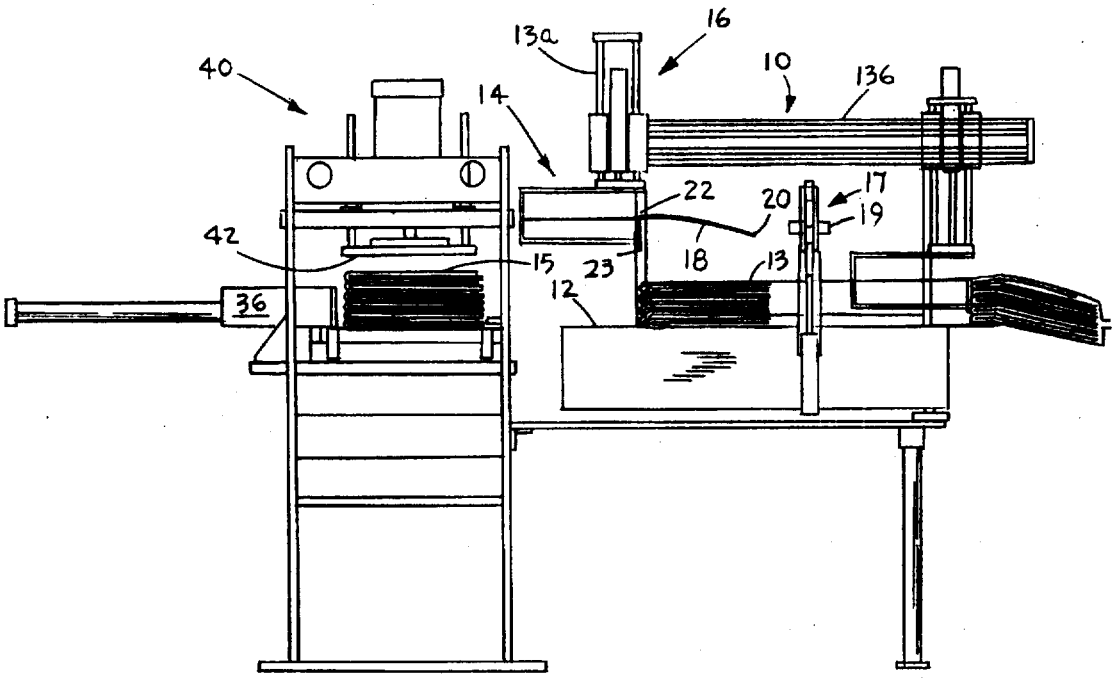
FIG. 1 is a side elevational view of the bagging machine comprising the present invention in combination with a compactor illustrating the product loading arm and the hold-down device associated in the rest or starting position in solid lines and in the bag discharge position in hidden lines.

Referring now to the drawings and particularly to FIG. 1, a frame shown generally as 10 includes a bag loading surface 12 positioned horizontally to receive a plurality of empty bags 13 and product 15 to be positioned therein. A product loading arm shown generally as 14 has suitable supporting structure 16 to enable vertical and horizontal movement of the arm with respect to vertical rods 13*a* and horizontal rods 13*b*. Appropriate motorized means and sensing devices such as photocells are utilized to selectively move loading arm 14 vertically and horizontally as needed. The components used in providing this vertical and horizontal movement are standard off-the-shelf items and do not constitute any novel features of the present invention.

A hold-down device 18 in the form of a resilient and arcuately shaped plate is affixed to loading arm 14. Plate 18 has a leading edge 20 and a supporting edge 22 which is affixed to loading arm 14 at a depending tab portion 23. Plate 18 is arcuately shaped and extends partially downwardly (FIG. 1) toward bag loading surface 12 to engage the articles to be bagged.

A bag opening mechanism includes a vacuum device shown generally as 17 operable to open a preformed bag to receive articles to be bagged. The mechanism is supported on loading surface 12 and is of a conventional construction that enables suction through a cup 19 to open an end of a single bag to receive a pair of hinged arms 28 that once introduced into the bag opening rotate slightly outwardly to snugly hold the bag opening in proper position for receiving product to be packaged. Side walls 30 are adjustably positioned through appropriate securing means 32 to form a product receiving compartment 34 substantially under loading arm 14.

Figure 4:
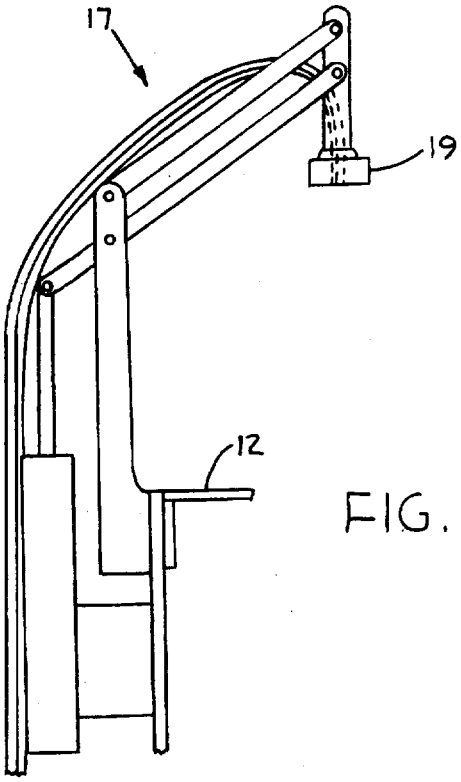
FIG. 4 is a side elevational, enlarged and fragmentary view of the vacuum device used to positively open bags for subsequent loading.
Figure 5:
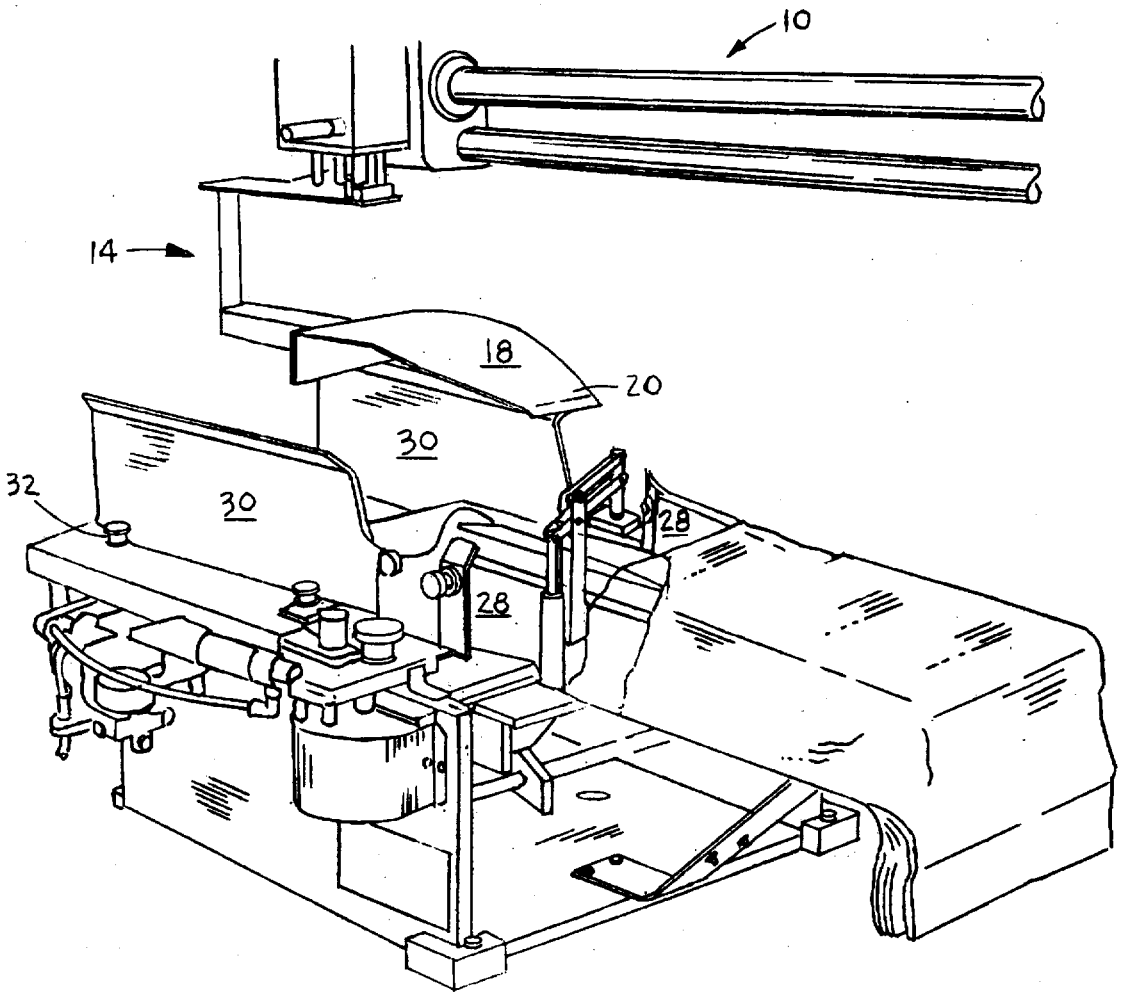
FIG. 5 is a perspective view of the combination machine shown in FIGS. 1, 2 and 3.

In operation, a plurality of articles to be bagged, such as socks 15, are positioned on surface 12 in either a compacted or uncompacted condition. Socks 15 are then urged by piston 36 onto bag loading surface 12 beneath loading arm 14 as best shown in FIG. 4. Loading arm 14 is then moved vertically downwardly against articles 15 until hold-down device 18 engages the upper surface of the garments. The downward movement of loading arm 14 and engagement of hold-down device 18 with the stacked plurality of socks 15 can cause some compaction which can be varied by adjustment. Once engagement has taken place, arm 14 and hold-down device 18 are moved horizontally, thus urging articles 15 along bag loading surface 12 and into the opened bag. Hold-down device 18 continuously grips the bagged articles and, because of its arcuate nature, urges then downwardly as they are moved off of the bag loading surface and onto a receiving location which might well be a continuously moving conveyor. Once the filled bag has been removed from the bag loading surface, loading arm 14 retracts horizontally and vertically to its original position to commence the operation of another cycle. As loading arm 14 and its associated accessories move back to its original position, another preformed bag is opened by suction device 19, and the movable jaws 28 are inserted and tensioned to retain the bag in an open condition during the balance of the cycle.

Figure 2:
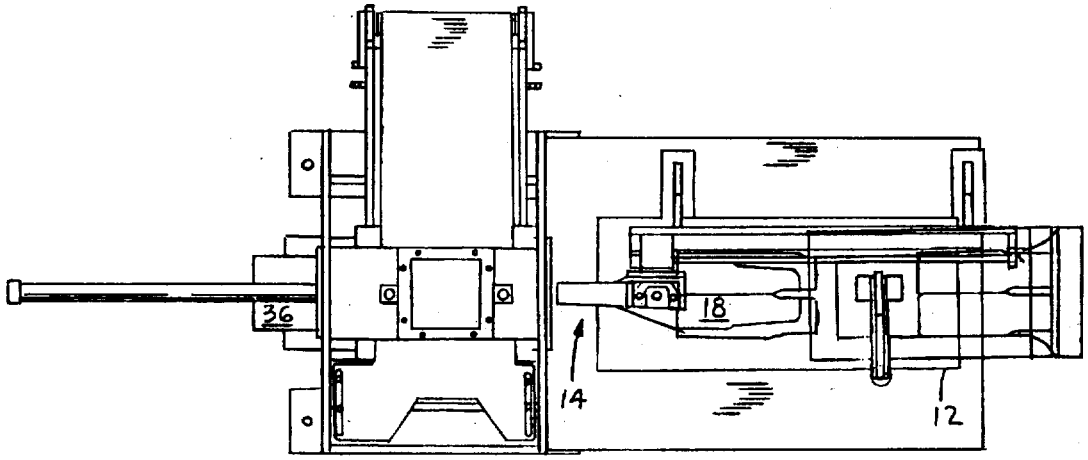
FIG. 2 is a plan view of the bagging machine shown in FIG. 1.
Figure 3:
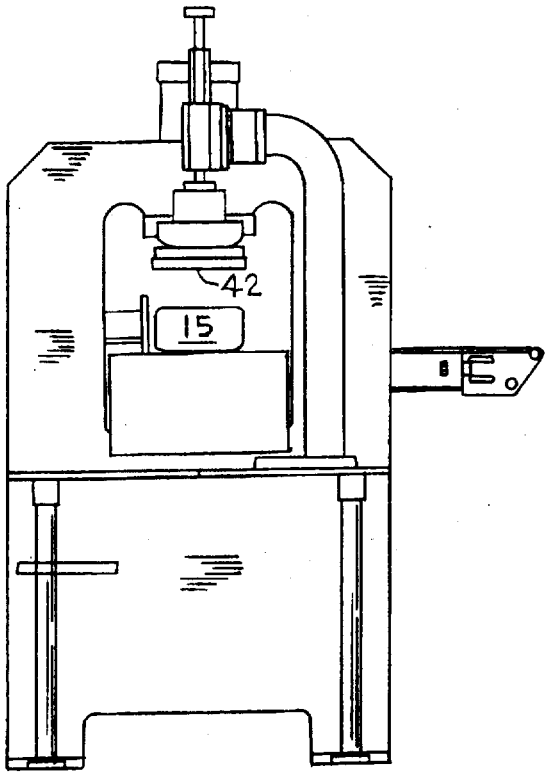
FIG. 3 is an end elevational view of the bagging machine shown in FIGS. 1 and 2.

The machine comprising the present inventive concept can be used manually for preconfigured packages or can be joined in combination with other machinery such as, for example, a compacting device shown generally as 40 and illustrated best in FIGS. 1–3. There a plurality of articles to be packaged, again for example, socks 15, are reduced in size by pressure exerted by the compacting machine platen 42 and thereafter transported by piston 36 to bag loading surface 12. The machine then operates in the manner previously described.

By coordinating the operation of the compacting machine with the bagging machine, systematic compacting and packaging takes place in a production manner, and consistent predictable volumes of packaged goods are produced on a regular basis.

Obviously, other machines may be connected in combination with the bagging machine comprising the present invention such as printing, labeling or tagging devices. Any machine capable of treating articles to be bagged in any form may be combined operably with the present invention to achieve a production line.

The foregoing description relates to preferred exemplary embodiments of the invention. Various changes and modifications may be made and features described in connection with one of the embodiments may be used with any other within the scope of the inventive concept.

What is claimed is:

1. A bagging machine for inserting semi-compressible articles having top and rearward portions into preformed bags comprising: frame means having a bag loading surface; an article to be bagged resting on the surface; a product loading arm having arm supporting structure to enable vertical and horizontal movement of the product loading arm with respect to the bag loading surface; means for selectively moving the product loading arm vertically and horizontally; a hold-down device associated with the product loading arm to engage the article to be bagged for moving the article to be bagged in a singular direction, wherein said direction is parallel to the bag loading surface; bag positioning and supporting means carried by the bag loading surface; bag opening means supported by the loading surface and operably associated with the bag positioning and supporting means; and bag receiving means adjacent the loading surface positioned to receive an article loaded bag for movement to a remote location, wherein the hold-down device includes an arcuate plate having an integral leading edge and an integral supporting edge, the supporting edge affixed to the product loading arm and including an integral depending tab portion capable of engaging the rearward portion of the article to be bagged, the arcuate plate extending partially downwardly toward the bag loading surface to engage the top surface of the article to be bagged.

2. The machine as claimed in claim 1 wherein the product loading arm includes means for detecting articles to be bagged and initiating preselected vertical and horizontal movement with respect thereto.

3. The machine as claimed in claim 2 wherein the bag opening means includes a suction device operable to open a preformed bag to receive articles to be bagged.

4. The machine as claimed in claim 3 wherein the bag receiving means includes a conveyor.

5. The machine as claimed in claim 1 wherein the bag opening means includes a suction device operable to open a preformed bag to receive articles to be bagged.

6. The machine as claimed in claim 1 wherein the bag receiving means includes a conveyor.

7. The machine as claimed in claim 1 wherein the frame means includes a compactor for compressing the articles to be bagged, and displacing means associated with the compactor to move the compressed articles to the bag loading surface.

8. The machine as claimed in claim 7 wherein the product loading arm includes means detecting articles to be bagged and initiating preselected vertical and horizontal movement with respect thereto.

9. The machine as claimed in claim 8 wherein the bag opening means includes a suction device operable to open a preformed bag to receive articles to be bagged.

10. The machine as claimed in claim 1 wherein the hold-down device compresses the product to be bagged.

11. The machine as claimed in claim 1 additionally comprising a means for detecting articles to be bagged and for initiating preselected vertical and horizontal movement of said product loading arm with respect to said articles.

12. The bagging machine of claim 11 wherein said detecting means is attached to the product loading arm.

13. The bagging machine of claim 1 wherein said product loading arm does not engage said articles.

14. The bagging machine of claim 1 wherein said hold-down device is capable of compressing the product to be bagged.

15. The bagging machine of claim 1 wherein said article is more than one item.

16. The bagging machine of claim 1 wherein the hold-down device and product loading arm act as one structure to engage both the top and rear of the product to be bagged, to keep compacting the product to be bagged as necessary, and to keep engaged with the product until the product is bagged.

17. A bagging machine for inserting semi-compressible articles having top and rearward portions into preformed bags comprising: frame means having a bag loading surface; an article to be bagged resting on the surface; an engaging means for engaging both the top and rear of the article to be bagged, for compacting the article to be bagged as necessary, and for remaining engaged with the article to be bagged while the article is bagged, said engaging means capable of vertical and horizontal movement with respect to the bag loading surface; means for selectively moving said engaging means vertically and horizontally; bag positioning and supporting means carried by the bag loading surface; bag opening means supported by the loading surface and operably associated with the bag positioning and supporting means; and bag receiving means adjacent the loading surface positioned to receive an article loaded bag for movement to a remote location, wherein the engaging means includes an arcuate plate having an integral leading edge and an integral supporting edge, the supporting edge affixed to a product loading arm and including an integral depending tab portion capable of engaging the rearward portion of the article to be bagged, the arcuate plate extending partially downwardly toward the bag loading surface to engage the top surface of the article to be bagged.

* * * * *